United States Patent [19]

Rubin

[11] Patent Number: 4,840,382

[45] Date of Patent: Jun. 20, 1989

[54] ELECTRONIC CARD READER AND FINANCIAL ASSET GAMES

[76] Inventor: Kenneth L. Rubin, 24 June St., Westwood, Mass. 02090

[21] Appl. No.: 146,220

[22] Filed: Jan. 20, 1988

[51] Int. Cl.[4] ..... A63F 3/00

[52] U.S. Cl. ..... 273/237; 273/256; 273/278; 273/1 E; 273/DIG. 28

[58] Field of Search ..... 273/237, 238, 256, 278, 273/292, 293, 1 E; 364/410; 434/308–311

[56] References Cited

U.S. PATENT DOCUMENTS

| | | | |
|---|---|---|---|
| 3,499,646 | 3/1970 | Burgess, Jr. et al. | 273/256 |
| 3,770,277 | 11/1973 | Cass | 273/278 |
| 4,002,342 | 1/1977 | Biggs | 273/256 |
| 4,266,775 | 5/1981 | Chitnis et al. | 273/278 |
| 4,363,489 | 12/1982 | Chodak et al. | 273/237 |
| 4,378,942 | 4/1983 | Isaac | 273/278 |
| 4,410,181 | 10/1983 | Lapp et al. | 273/238 |
| 4,431,195 | 2/1984 | Brand et al. | 273/256 |
| 4,522,407 | 6/1985 | Hatherley | 273/256 |
| 4,681,548 | 7/1987 | Lemelson | 434/311 |
| 4,729,564 | 3/1988 | Kuna et al. | 273/1 E |

*Primary Examiner*—Leo P. Picard
*Assistant Examiner*—Jessica J. Harrison
*Attorney, Agent, or Firm*—Hamilton, Brook, Smith & Reynolds

[57] ABSTRACT

A card reader reads encoded game cards and supplies the information read to a logic system such as a microprocessor. With such information the logic system causes changes in the current state of the game. A financial asset or commercial market game employs the card reader and encoded game cards plus a display for indicating current prices of the financial assets and, a game board having a plurality of squares by which players acquire information prior to that of other players or gain or forfeit sums of money. Optionally, a video display or television set interface may be used for the display of said prices. A music identification game employs the card reader and another set of encoded game cards and plays portions of music compositions encoded on the cards. A player limits the amount of the portion of the composition played through control circuitry connected to the card reader.

28 Claims, 3 Drawing Sheets

ELECTRONIC CARD READER AND FINANCIAL ASSET GAMES

BACKGROUND OF THE INVENTION

This invention relates to electronic games, and specifically to commercial transaction games involving stocks, commodities or other financial assets, and music identification games.

There are games that achieve the representation of random events through a deck of cards that are shuffled and then drawn sequentially throughout the game. These games have the advantage of being easy to use, and also allow some information to be known in advance by only one player by opportunities for selective viewing by the player. On the other hand, electronic games, such as computer or microprocessor based games, use random number generator programs to generate sequences that are then applied to a series of events, and thereby provide random occurrence of the events. Such electronic games also allow electronic interpretation of the event or information. However, this method is often not representative of standard game play, plus it does not conveniently allow for one player to preview information as does card oriented information. It is a purpose of this invention to provide a method by which information can be contained on cards, yet be supplied to an electronic system for electronic processing.

There are many examples in the prior art of stock market games. These games range from simple board games that do not adequately represent the underlying forces that cause markets to move, or electronic games that are unduly complex and do not allow for persons not versed in the market to participate. Furthermore, both these types of games do not reflect how both "fundamental" and "technical" factors affect markets. As used herein "fundamental" factors refer to cause and effect relationships between events and stock market prices, and "technical" factors refer to mathematical relationships made between the varying prices of the same item over a period of time and/or between prices of different items. It is a purpose of this invention to provide a game which reflects the effects of both fundamental and technical factors on the market.

SUMMARY OF THE INVENTION

An electronic based game of the present invention employs a set of cards which are encoded with different information for providing an element of change in the state of the game, and a card reader which reads the cards and causes a microprocessor to change the status quo of the game according to the information read from the cards. The information is encoded on the cards by various patterns of reflective, less-reflective and non-reflective elements. Alternatively, the patterns may be formed by elements varying in translucence. The card reader reads the cards using a reflective infrared emitter-sensor assembly or a transmissive infrared emitter-sensor assembly. The infrared emitter-sensor assembly senses light reflected (or transmitted) in an amount indicative of the information encoded on the card.

In a particular application, the present invention employs such a card reader in a game to adequately represent the forces that drive stock, commodity or other financial asset markets while maintaining an approach simple enough for the average game player to follow.

A financial asset game employing the card reader consists of the following components:

(1) Play money, in denominations from $100.00 up to $100,000.00, and a repository for this money hereafter referred to as "the bank".

(2) Certificates each representing one hundred or some other predetermined number of units of a financial asset represented in the game. The repository of the certificates is the bank.

(3) A pair of standard six sided dice.

(4) Game board tokens representing the players.

(5) A set of game cards, with events which affect the prices of financial assets in the game indicated on the cards in English or other language and in coded form readable by the card reader. The cards are divided into two decks, one called the "event" deck and another deck called the "information" deck.

(6) A board, itself consisting of a plurality interconnected squares in two concentric loops or tracks, with one or more paths of squares between the two loops. The inner loop is labeled the "fast track", and the sums of money that are obtained or lost by landing on a square in the fast track are much greater than those in the outer "slow" track. Players start at a square in one corner of the board, collect a fixed amount called "salary" every time they pass this square, and move in accordance with the roll of a pair of dice. Although there exists one or more paths between the slow and fast tracks, some squares do not allow landing by a player, thus preventing the player from moving from one track to the other.

(7) A box-like housing containing electronic components of which are included:

an on/off switch;

a receptacle for batteries by which to power the electronic components;

a card reader;

a microprocessor and associated circuitry, a part of which embodies an algorithm that moves or modifies prices on the basis of buy/sell action and card input;

display driver(s) to drive displays of prices and indications of transactions which occur throughout the game;

liquid crystal displays, or drivers so that a standard television set or video display can be used in place of said displays, to display the financial asset prices, a transaction total or other numeric quantities, and other information such as buy and sell prompts and indicators of the direction of the last move of a price; and an array of push buttons by which players can indicate financial assets and amounts of the financial assets to buy or sell as well as the buy/sell choice itself, and confirm and cancel buttons for the buy/sell choices.

The algorithm or embodiment of the algorithm in silicon by which the microprocessor adjusts financial asset prices has the following features:

By using an average of changes in individual financial asset prices, such as a weighted average or moving average, the microprocessor circuitry perpetuates or opposes individual financial asset or whole market price trends as per the instructions on the game cards read by the card reader.

By counting card reader insertions, time based technical factors such as "time cycles" can be realized.

In addition to moving prices as per a price trend, game cards can cause price movement of a particular financial asset or group of financial assets in a particular direction.

Furthermore, buying and selling action by the players will move prices up and down, respectively, to reflect the law of supply/demand or buying/selling pressure on prices.

By combining all these factors in the circuitry, the game is made to simulate the effect of market prices due to fundamental factors (i.e. events of the cards, such as RISE IN GNP ANNOUNCED), technical factors (i.e. the manipulation of individual financial asset prices according to market prices and trends) and the reflection of buying and selling pressure in prices.

In a music identification game employing the card reader, the microprocessor reproduces portions of different musical compositions as indicated on the series of game cards which are read by the card reader one at a time in random order throughout the game. The object of the game is to be the first player to identify the different musical compositions as they are played through the card reader and microprocessor, and to be the player to make the most identifications.

The music identification game comprises:

a deck of game cards, each card with a different name of a musical composition on one side and a different pattern of machine readable bars on an opposite side which is read by the card reader; and a box containing electronic components including:

an on/off switch, a receptacle for batteries by which to power the electronic components, the card reader, player buttons, preferably hand held push buttons connected to the microprocessor, and the microprocessor with associated circuitry including a tone generator for recreating portions of musical compositions as encoded by the machine readable patterns on the game cards, and an embodiment of an algorithm by which the music is reproduced and other input is processed.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DESCRIPTION OF THE PREFERRED EMBODIMENT

Figure 1:
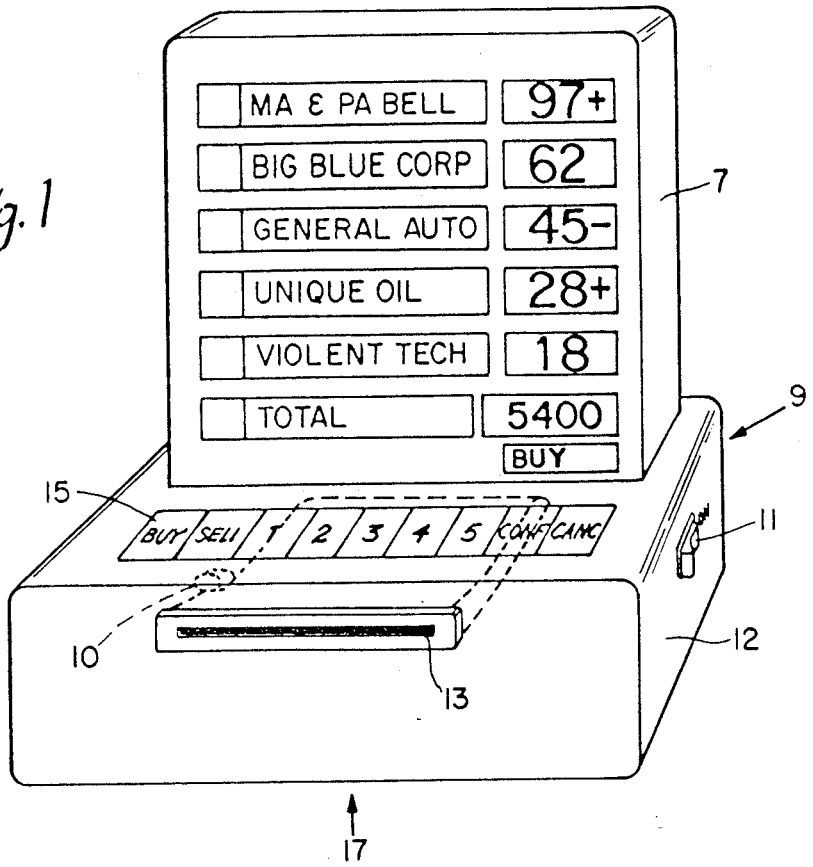
FIG. 1 is a perspective view of a game electronic assembly employing a card reader, electronic processor, display and control circuitry of the present invention.

A game of electronic assembly 17 embodying the present invention is illustrated in FIG. 1. The assembly 17 includes a display portion which is generally designated as 7 and a processor portion which is generally referred to as the main electronic unit 9. The main electronic unit 9 includes a box-like housing 12 having an on/off switch 11 and a slot 13 through which cards are introduced to the card reader 10 residing within the housing 12, a microprocessor and associated control circuitry (not shown) within the housing 12 and a row of player depressible buttons or keys 15 on a top surface of the housing 12.

The display portion 7 may employ liquid crystal displays or a television output or other video output driven by the control circuitry of the main electronic unit 9.

Two embodiments for the card reader 10 are described next, both residing within a housing similar to that illustrated in FIG. 1 with a slot through which a card can be guided past the electronic components of the card reader 10.

In the first embodiment of the card reader 10, the basic electronic component consists of a reflective infrared emitter-sensor assembly. The emitter-sensor assembly is aimed on an area within the housing across which a card will be guided when inserted into the slot. Each card carries its coded information in rows of varying areas of reflective and non-reflective or less-reflective elements. That is, the information is encoded by patterns of light and dark segments on the card. The card is inserted through the slot, and the varying areas are guided past the emitter-sensor assembly mounted within the housing. The output of the emitter-sensor assembly varies with the amount of light reflected to it from the surface of the card from the areas of varying reflectivity. This output is sent to the microprocessor which translates the varying signals into a sequence of numbers that are related to and interrupted by the other operations of the game. Bars printed on the card can be used for a sequence of areas that can be measured and related.

In the second embodiment of the card reader 10, the basic electronic component consists of a transmissive infrared emitter-sensor assembly. The emitter-sensor assembly is positioned within the housing so that the card will pass between the transmission and reception parts of the component. The receptor part of the component will receive light from the transmission part in a varying amount as per the varying translucence of the areas on the card. In this case, the varying areas on each card can also be represented by holes which allow more light to be transmitted through the card area between the source and the receptor. Printed bars can be used since they will cause different amounts of light to be transmitted through the cardboard or card paper of the card to the receptor.

Other card reader components or a combination of the above described reflective/transmissive emitter-sensor assemblies may be used. Similarly, the cards may carry their encoded information by other methods or by a combination of patterns of segments varying in ability to transmit and reflect light.

Figure 2:
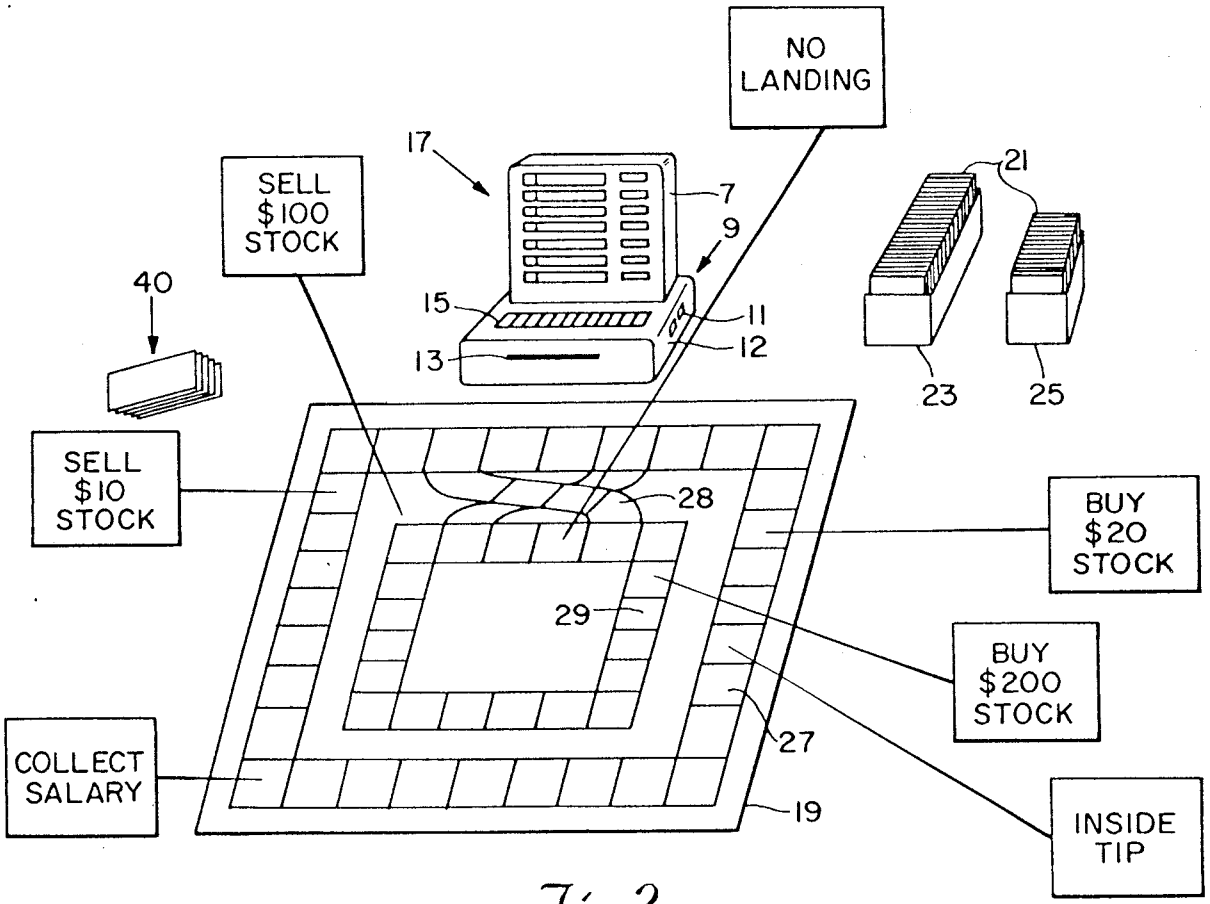
FIG. 2 is a schematic of a stock market game embodying the present invention and employing the electronic assembly of FIG. 1.

A stock market game embodying the present invention is illustrated in FIG. 2. Although the game is specific to the stock market, other games relating to real estate or other commercial markets may similarly employ the game electronic unit 17 and encoded game cards of the present invention. The stock market game employs, among other items, the game electronic assembly 17, a game board 19, a set of encoded cards 21 which indicate in human readable language as well as in a form readable by the cards reader different price-affecting events, stock certificates and play money 40. In the row of player depressible buttons 15 of the main electronic unit 9, there if a "buy" button, a "sell" button, a "confirm" button, a "cancel" button, and for each company represented in the game, a corresponding stock button for the stock of that company.

The game board 19 has a plurality of interconnected segments or squares which form two concentric loops or tracks 27, 29. One or more series of interconnected squares form a path or paths 28 between the two tracks. The squares forming the inner track 29 referred to as the "fast track", require a player landing on one of them to lose or gain greater sums of money than the squares of the outer "slow" track 27. One square is designated as the square at which players begin the game. Other squares do not allow a player to stop or land on them and are called "no landing" squares.

At the initial stage of the game, the on/off switch 11 of the main electronic unit 9 of the game electronic assembly 17 is turned on and the microprocessor causes the display 7 to exhibit the initial stock values for the stocks in the game. Throughout the game, the microprocessor will cause the display 7 to exhibit the most current values (i.e. prices per share) for the stocks. The set of cards 21 are divided into a large pile or tray called the "event" card deck 23 and a small pile or tray called the "inside information" or "tips" card deck 25. Each player is given $25,000 in play money 40, and tokens representing the players are placed on the start square of the game board 19. The highest roll of a pair of dice determines which player initiates play. Play moved from player to player in clockwise rotation. Each player performs the following sequence, the sequence of which is called a "turn" of play:

1. A player rolls the dice. The sum of the dots on the top faces of the dice indicate the number of squares the player advances his token around the board. The player may move his token along the track (27 or 29) he is currently on or move from one track to the other unless the final square of the move puts the player token on a "no landing" square. After moving the token representing the player to a final square, the instructions printed on the square are followed. Most of the instructions printed in the squares of the board result in money being owed to or received from the bank. Some squares will result in the player skipping all other action in his present turn. Other squares will allow the user to draw a card from the "inside information" pile 25, read the card privately, and insert it at a location of his or her choice in the "event" card deck 23. In this manner, the player has exclusively obtained information of an event in advance of its occurrence in the game. A player can collect a sum called a "salary" each time he passes a particular square.
2. The player can buy or sell stock, either to or from the bank, or to or from other players. If buying or selling with another player, the two players negotiate the price of the transaction. If another player offers a better price than that indicated on the display 7, the player must make the transaction with that player. If buying from the bank, the player presses the "buy" button in the row of player depressible buttons 15, then the stock button corresponding to the stock the player wishes to buy. Each press of the stock button corresponding to 100 shares of the stock that the player wishes to buy. The total owed for the transaction is indicated in a section of the display 7 labelled "total". The player then confirms the purchase by pressing the "confirm" button, or cancels the purchase by pressing the "cancel" button. If confirmed, the player pays the bank the amount indicated in the total and takes the appropriate stock certificates from the bank.

If selling to the bank, the player presses the "sell" button, then the stock button corresponding to the stock the player wishes to sell. Each press of that stock button corresponds to 100 shares of the stock that the player wishes to sell. The total due for the transaction is indicated in the "total" section of the display. The player then confirms the sale by pressing the "confirm" button, or cancels the purchase by pressing the "cancel" button. If confirmed, the player collects the amount indicated in the "total" section of the display from the bank and gives the appropriate certificates to the bank.

It is understood that other arrangements of stock, confirm and cancel buttons, and buttons for tallying the number of shares involved in the transaction may be used. A game card 21 is drawn from the beginning of the "event" deck 23, is read aloud by the player and is inserted into the slot 13 of the main electronic unit 9 of the game electronic assembly 17. The microprocessor then adjusts the prices of the stocks on the basis of the interpretation of the event encoded on the event game card via the controlling program.

For each stock whose price changed during the last buy/sell transaction or event processed by the microprocessor, the display provides an indication (e.g. + or −) of the direction of each price change.

The game is won when a player has $100,000.00 or a predetermined amount, in cash, upon crossing the starting square positioned at one corner of the board.

The preferred embodiment of the controlling program residing in the microprocessor or associated circuitry reflects the following actions.

The change in price of a stock relative to previous changes in price of the stock, called the trend movement or delta of the stock, is determined for each stock represented in the game by a weighted average or moving average. The trend movement is indicated as a positive or negative amount indicating the general direction and magnitude of a stock's recent change in price. For example, a trend movement of +3 for a certain company's stock implies the stock has been advancing, with the magnitude of '3' indicating the relative strength of the advance. Similarly, a trend movement for a stock of −10 indicates that the stock has been declining with much greater force or magnitude.

In a weighted average, each time the trend value is calculated (new value of the stock minus the old value of the stock) the weighted average is calculated by adding the newly calculated trend value to the produce of (weight - 1) and the old trend value, then the sum is divided by (weight).

The weight is a positive integer greater than 0. For example, with a weight of five the weighted average would be:

$$\frac{4\text{ (old trend value)} + \text{new trend value}}{5}$$

A slower or faster weighted average can be achieved by using different weighting between old and new trend values. For instance one can use a weight of nine, and the weighted average would equal:

$$\frac{8\text{ (old trend value)} + \text{new trend value}}{9}$$

This larger weight would achieve a slower changing trend movement.

In a moving average, a certain number of, say 10, old trend values are kept for each stock, and these are averaged. When a new trend value is obtained, the oldest trend value is eliminated, and the new trend value replaces it. As per the weighted average, the moving average can be weighted to give the new trend value more weight than each old trend value.

With the trend movement calculated for each company stock, a trend for the market as a whole can be calculated by an average of the trends of the individual stocks or by other known methods. The calculated market trend can be superimposed on the trend of each company stock to provide more complex action.

The price changes in a stock or stocks can be dependent as well on other technical factors. For example, by counting card reader insertions as a unit of time, time cycles can be superimposed on the other price action.

When a buying or selling transaction is completed as described previously, the company stock price involved in the transaction is incremented or decremented by the controlling program to reflect the buying or selling pressure. Furthermore, event game cards will have one of several effects via the controlling program:

- a certain company stock price will be adjusted up as per the code on the card;
- a certain company stock price will be adjusted down as per the code on the card;
- all stock prices will be adjusted up as per the code on the card;
- all stock prices will be adjusted down as per the code on the card;
- all stock prices will be adjusted to perpetuate the current trend;
- all stock prices will be adjusted to oppose or counter the current trend.

A random number input to the controlling program can be used to add a random nature to the initialization of the stock values and the foregoing card generated stock price adjustments.

Figure 3:
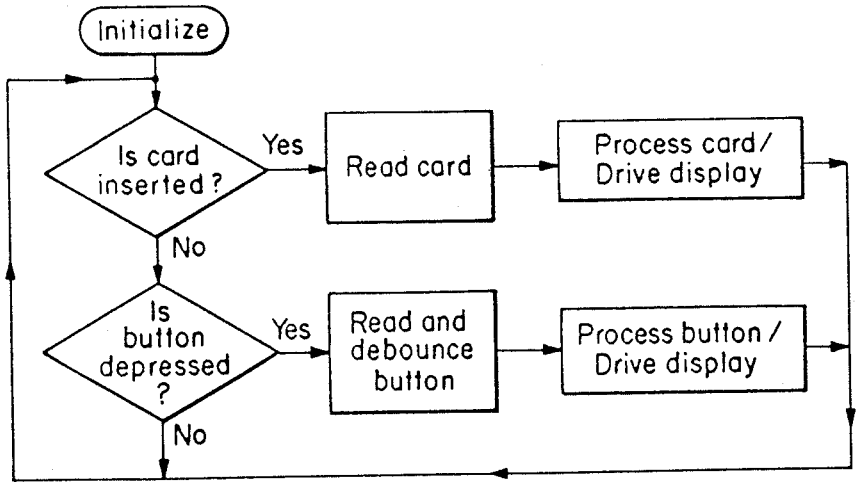
FIG. 3 is a flow chart of the control program of the electronic processor for the stock market game of FIG. 2.

A flow chart of the controlling program is provided in FIG. 3 and begins with the initialization of the game by the turning on of switch 11. After the game is initialized and initial prices per share of stocks are displayed, the control program monitors the card reader for input over processor lines to the microprocessor. If input from the card reader is detected, the control program collects the input (i.e. reads the information from the card which has been inserted into the card reader) and processes the input.

The input is generally processed in the following manner but may be processed in other manners. The input line from the card reader to the microprocessor varies from low to high in accordance with the degree of light reflected/transmitted from the basic electronic component of the card reader. The transitions between low and high are timed and a sequence of numbers is generated using the simple relationship that the amount of time the signal is "on" is proportional to the width of the bar on the card. The generated sequence of numbers is supplied to the microprocessor. The sequence of number indicate three factors, (1) individual stocks or whole market, (2) trend or countertrend or up or down, and (3) magnitude or amount.

Upon recognizing a complete input from the card reader, the microprocessor then "executes the code" to perform the necessary action. The microprocessor decodes the sequence of numbers supplied by the card reader into quantities representing the three factors indicated above, that is, stock/whole market, trend/countertrend/up/down and magnitude/amount. For example, the first three bits read into the microprocessor can be interpreted as a number from 0 to 7. If the number is 0, the card represents a whole market action. Numbers 1–5 can represent stocks from five companies respectively. In a similar manner, the succeeding two bits can be interpreted as the numbers 0–3, corresponding to trend, countertrend, up or down. The last N bits can be interpreted as amount. It is understood that other configurations may be used. For example, the configuration could be changed so that specific information for each of the five stocks is read in at once, such as Stock1/up/amount1, Stock2/up/amount2, Stock3/down/amount3, Stock4/trend/amount4, Stock5/countertrend/amount5.

Once these three quantities are identified by the microprocessor, the microprocessor takes the specific action indicated. For instance, if the card reads, market/up/10, then the microprocessor will adjust each stock price to reflect a general market which is adjusted or moved upward by a relatively strong amount. A card reading Stock5/down/3 would cause the microprocessor to adjust the stock of the fifth company represented in the game down but in a somewhat weak amount.

Further, the microprocessor employs weighted averages or other mathematical representations that stock market analysts call "technical tools", such as time cycles, in performing the specified action. For instance, when a "trend" card is read in, the market trend is calculated by some method, perhaps by taking a simple average of the five companies' stock trends. Then, for each stock, the market trend is combined with the individual stock trend to get a composite trend for that stock for this "trend" action. This composite trend is then used as a factor by which the price of that stock is adjusted. A random number can also interject some degree of variability into this calculation to produce more varied action. As an example, for simplicity, assume that the manner of combining the stock trend with the market trend is a simple average, and the five stocks have weighted trends of +3, +10, +4, −5 and +8 respectively. The average of these is +4. For the first company's stock, its composite trend would be (3+4) divided by 2 equals +3.5. For the second, the composite trend would be (10+4) divided by 2 lequals +7; for the third, (4+4) divided by 2 equals +4; for the fourth, (−5,+4) divided by 2 equals −0.5; and for the fifth (8+4) divided by 2 equals +6. By this simple method, a number for each company stock is achieved that superimposed the individual stock trend with the market trend. That is, stock of the fourth company is trending down moderately, but the market is trending up, so that composite action is trending down slightly. Also, stock of the second company is trending up strongly so its composite trend with the upward trend in market is also up strongly.

As an added interest factor in the game, a game card that calls out a specific stock could manipulate that stock accordingly, and could also manipulate the other stocks in accordance with the trend as in the paragraph above as if a market/trend/middle amount card was read in along with the stock specific card.

The foregoing discloses how technical factors are employed in the game. It should also be readily apparent how fundamental factors are represented in the game. If a card says "Company1 invents new widget", the card may have encoded on it "Stock1/up/10" to produce a representative action since the inventio of a new product means higher future earnings and therefore enhanced company profits. Or, a card saying "Federal Reserve cuts discount rate" could have encoded on it "market/up/10" to cause higher stock prices in general since lower interest rates stimulate the economy. In both cases the microprocessor combines this action with the current trend amount to achieve a reflection of both fundamental and technical factors. After a card is read and the prices are adjusted, the microprocessor drives the display to provide an indication of the adjusted prices. The microprocessor then calculates new trends of each stock on the basis of the last set of changes in the stock prices.

The control program also monitors the player depressible buttons in a fashion similar to the monitoring of the card reader. Once input from the depressible buttons is detected over processor lines to the microprocessor the control program via timing loops refine the input. The detected button is read and debounced. If the button is a "buy" or "sell" button the microprocessor sets a flag in the control program to denote that a buying or selling transaction is occurring. If the button is a stock button, the state of the buy/sell flag is checked, and if a buy/sell is taking place, then the price for that stock is added into a register storing the buy/-sell total and is displayed in the "total" section of the display. A counter is incremented according to the buttons pressed by the player to designate the number of hundred-share blocks being bought/sold. The counter is logically connected to the register to provide a total price of the transaction. If the buy/sell flag is not set, the control program indicates an error. If the button detected is "cancel", the microprocessor then zeros the register storing the total, sets the counter to zero and clears the buy/sell flag. If the "confirm" button is detected and the buy/sell flag is non-zero, the processor adjusts the price of the stock to reflect the buying/selling pressure on the price of the stock, zeros the register storing the total and zeros the buy/sell flag and counter.

The price adjustment based on confirmed buy/sell button presses should reflect whether the player is buying or selling with or against the trend, as well as the volume or number of shares bought or sold. For example, if buying and the trend is up, the price of the stock should be adjusted up since the trend reflects high demand. If buying and the trend is up in a stronger fashion, the price of the stock should be adjusted up more. If buying and the trend is down, the price is not adjusted from the buy since demand is low and selling is the dominant action on the stock. Similarly, the volume or number of shares can add to the buying/selling pressure or supply/demand.

After processing a game card or player buttons, the control program returns to waiting for or monitoring button presses and card insertions.

It is understood that the stock market game may be modified to include or concern, singularly or in combination, commodities, futures or other financial assets.

Figure 4:
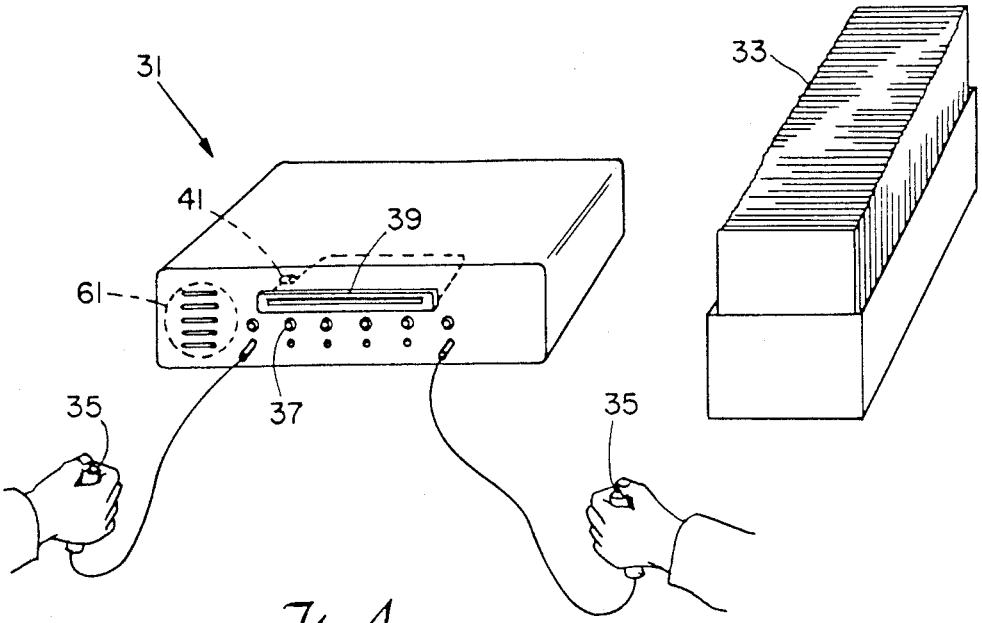
FIG. 4 is a schematic view of a music identification game employing an electronic assembly embodying the present invention.
Figure 5:
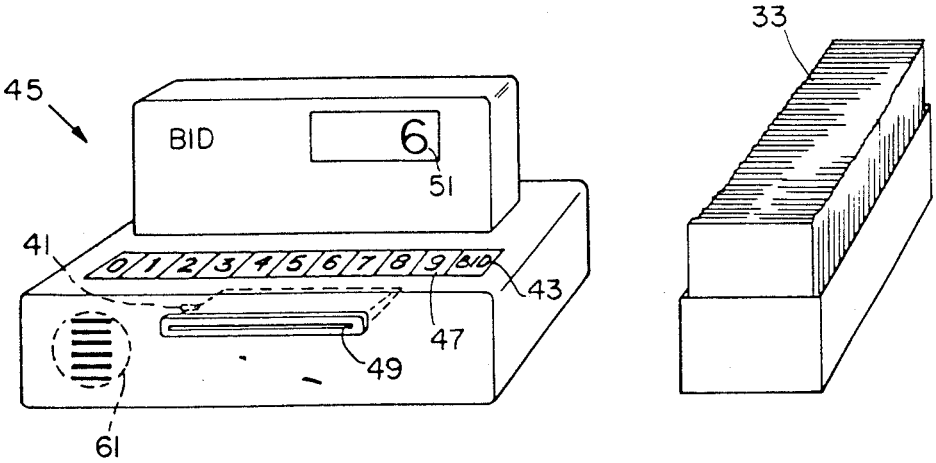
FIG. 5 is a perspective view of another music identification game embodiment of the the present invention.

Two embodiments for a musical identification game are given next both using the same or similar components as shown in FIGS. 4 and 5, differing in play methodology. The game components consist of:

- the electronic assembly 31 (45) including a card reader 41, microprocessor, tone generator driven by the microprocessor, and speaker or other tone device such as a piezoelectric tweeter 61;
- a set of game cards 33, on one side of which are the names of musical compositions, on one side of which is the machine readable encoding of a portion of the named composition;
- player buttons 35 (47, 43) which are on/off devices whose state can be detected by the microprocessor or other electronic controller; and
- a display 37 (51) by which indications of a player (i.e. by player number) or other numbers can be exhibited.

Encoding of a portion of a musical composition on each card 33 can be accomplished by encoding tones and durations as a sequence of numbers, and representing these numbers by bars varying in reflectivity or translucence on the cards. Each t1one for two octaves can be represented by one of twenty four numbers. Each number can then be followed by a number indicating duration in increments of sixteenth notes. By using sequences of these encodings of pitch/duration, short segments of compositions can be represented as numbers and these numbers encoded as printed bars on the game cards.

The card reader 41 reads the game cards 33 and generates a sequence of the above described numbers. The sequence of numbers are received by the microprocessor which in turn interprets the numbers and drives the tone generator accordingly. This results in the playing of the encoded composition.

In one musical identification game illustrated in FIG. 4, a game card 33 is drawn from a shuffled deck of musical composition game cards. The card 33 is drawn in a manner that the name of the composition is not visible to the players. The card 33 is then introduced to the card reader 41 through slot 39 shown in FIG. 4, and the microprocessor plays the composition segment. When a player can identify the name of the composition, or the name and author of the composition as per the game chosen, he presses his player button 35 and writes down his guess of the name of the composition. Each player button 35 corresponds to a player with a player number (i.e. 1 ...N) such that the player whose button is pressed first is indicated on the display 37. That player states his answer and checks the card. If his answer is correct according to the composition name and/or author written on the one side of the card, he gets a point. The first player to obtain fifty points wins the game.

An illustration of a second musical identification game is provided in FIG. 5. In this game, the name of the composition represented on the card 33 appears on the same side of the card as the encoding bars. On the opposite side of the card is a clue to the identification of the musical composition. A game card 33 is drawn, and the clue is read aloud so that all players can hear the clue but no players can see the identification. The players, one at a time, each bid on the number of notes it would take him to identify the composition based on the clue. The player making the lowest bid presses the button 43 marked "bid" on the electronic assembly 45 and enters the number of notes he bid through numeric buttons 47. He then inserts the game card into the card reader through slot 49. The microprocessor and tone generator of the electronic assembly 45 then plays the bid number of notes (i.e. the number entered through buttons 47) of the composition encoded on the card. The player then must identify the composition and/or author. After stating his guess of the name of the composition, the player removes the card and reads to himself the title/author of the composition to determine if he/she is correct. If correct, that player gets points as indicated in the display. If not, he loses that number of points, and the other players bid again on the same composition, and the process repeats, until a player correctly identifies the composition names and encoded on the game card, or no bids are left. The first player to achieve fifty points wins.

While the invention has been particularly shown and described with reference to preferred embodiments thereof, it will be understood by those skilled in the art that various changes in form and details may be made therein without departing from the spirit and scope of the invention as defined by the appended claims. For example, the disclosed electronic assembly with a card reader, electronic processor and associated circuitry may be employed in other games with other sets of encoded cards.

I claim:

1. Game apparatus for a competitive game to be played by two or more players comprising:

a display for indicating a current state of the game;

a plurality of cards encoded with different information affecting the current state of the game;

processor means for receiving signals and processing signals to determine the state of the game;

a card reader logically connected to the processor means for reading at least one card at a time and generating signals indicative of the encoded information read from the card; and player input means for allowing players to communicate to the processor means, a player communicating decisional information to the processor means through the player input means, and the player input means generating player decision signals indicative of the decisional information from the player;

the processor means being responsive to both the signals generated by the card reader and the player decision signals by causing a change from the current state of the game to a new state of the game with respect to the encoded information read from the card, the decisional information communicated by the player and any previous information, and by causing the display to provide an indication of the new state of the game, the state of the game being effectively controlled by the player communicated decisional information and the encoded information read from the card.

2. Game apparatus as claimed in claim 1 further comprising:

a multiplicity of financial assets each having a name and a corresponding price;

the display exhibiting the financial asset names and corresponding prices;

the player decision signals providing an indication of a player communicated trade formed of a financial asset name and a specified number, the processor means responding to generated player decision signals by causing the display to exhibit a total dollar amount of the player communicated trade; and the cards being encoded with information which effects in a certain manner the corresponding price of at least one certain financial asset, the card reader reading one of said cards and generating signals indicative of the information, the processor means responding to the signals generated by the card reader by calculating a new corresponding price of the certain financial asset adjusted in the certain manner and by causing the display to exhibit the new corresponding price of the certain financial asset.

3. Game apparatus as claimed in claim 2 further comprising a game board having a plurality of interconnected sections which form two concentric loops connected together by at least one path of sections, each section having indicia requiring a certain action, the sections of one of the concentric loops requiring different actions involving higher total dollar amounts than the sections of the other concentric loop.

4. Game apparatus as claimed in claim 3 wherein:

the cards are humanly readable; and at least one section of the game board enables player reading of a card to himself in advance of a moment of the game in which the card is to be read by the card reader such that one player is the only player who knows the information on the card until the moment in which the card is read by the card reader.

5. Game apparatus as claimed in claim 2 wherein the processor means responds to the generated player decision signals by calculating a new corresponding price of the financial asset corresponding to the financial asset name in the trade communicated to the processor means with respect to the specified number in the trade.

6. Game apparatus as claimed in claim 2 wherein the processor means responds to the generated player decision signals by calculating a new corresponding price of each financial asset according to the financial asset corresponding to the financial asset name of the communicated trade and the specified number in the communicated trade.

7. Game apparatus as claimed in claim 2 wherein the player input means include a series of depressible buttons comprising:

a sell button for the player to communicate to the processor means that he wants to sell a financial asset;

a buy button for the player to communicate to the processor means that he wants to buy a financial asset;

a button for each of the financial assets, a depressing of which communicates the financial asset name of the respective financial asset to the processor means; and means for tallying and subsequently communicating to the processor means the specified number in the trade.

8. Game apparatus as claimed in claim 7 further comprising a cancel button for the player to communicate to the processor means that he wants to cancel the communicated trade with the bank.

9. Game apparatus as claimed in claim 1 further comprising a confirm button for the player to communicate to the processor means that he wants to confirm the communicated trade with the bank.

10. Game apparatus as claimed in claim 1 wherein the encoded information on the plurality of cards comprise various patterns of reflective and less reflective segments.

11. Game apparatus as claimed in claim 1 wherein the encoded information in the plurality of cards comprise various patterns of transmissive and less transmissive segments.

12. Game apparatus as claimed in claim 1 wherein the card reader comprises a reflective infrared emitter-sensor assembly which senses light reflected from a card in an amount indicative of the encoded information on the card to read the card.

13. Game apparatus as claimed in claim 1 wherein the card reader comprises a transmissive infrared emitter-sensor assembly which senses light transmitted through a card in an amount indicative of the encoded information on the card to read the card.

14. Game apparatus as claimed in claim 1 wherein:

the cards are humanly readable and are readable by chance during the game by one player to himself in advance of a moment in the game in which the card is to be read by the card reader, such that the information on the card is known only by the player during a portion of the game.

15. Game apparatus for a financial asset trading game comprising:

a plurality of financial assets;

a display for providing to all players an indication of a name and price per unit of each financial asset;

a plurality of cards encoded with information, the information utilized to change the prices of various financial assets;

processor means for receiving signals and processing signals to determine the state of the game;

a card reader logically connected to the processor means for reading the information from the cards;

a game board having a plurality of interconnected sections, said sections connected in a manner as to form two concentric loops connected together by at least one path of sections, each section of said game board having indicia thereon requiring a different player action in addition to the card reader reading a card such that a new price of at least one of the financial assets is calculated and indicated on the display.

16. Game apparatus as claimed in claim 15 wherein the information encoded on the plurality of cards comprise various patterns of reflective and less reflective segments.

17. Game apparatus as claimed in claim 15 wherein the information encoded on the plurality of cards comprise different patterns of transmissive and less transmissive segments.

18. Game apparatus as claimed in claim 15 wherein the card reader comprises a reflective infrared emitter-sensor assembly which senses light reflected from a card in an amount indicative of the information encoded on the card to read the card.

19. Game apparatus as claimed in claim 15 wherein the card reader comprises a transmissive infrared emitter-sensor assembly which senses light transmitted from a card in an amount indicative of the information encoded on the card to read the card.

20. Game apparatus as claimed in claim 15 wherein: the cards are humanly readable; and at least one section of the game board indicating to a player to read a card to himself in advance of a moment of the game in which the card is to be read by the card reader such that the player is the only player who knows the information on the card until the moment in which the card is read by the card reader.

21. Game apparatus as claimed in claim 15 further comprising:

play money; and the sections of one of the concentric loops require different actions involving higher amounts of play money that the sections of the other concentric loop.

22. A method of simulating the commercial market in a game having processor means, the method comprising the steps of:

displaying a name and a price per unit of each financial asset of a plurality of financial assets tradeable in the commercial market simulated in the game;

trading of the financial assets in a succession of player by player turns of play in the game;

changing the prices according to the financial assets and amount of the financial assets traded during the succession of player by player turns of play in the game;

changing the prices according to different information encoded on a plurality of cards, the cards being machine read in a random sequence throughout the game; and displaying the changed prices as the changes occur.

23. A method as claimed in claim 22 wherein the steps of changing prices include:

computing for each named financial asset its most recent change in price and its changes in prices over a period of time;

computing an overall price change for all prices currently displayed from an average of the changes in prices over a period of time of all the named financial assets;

superimposing for each named financial asset the overall price change with the respective most recent price change of the financial asset to form a current trend;

applying the information read from the cards to the current trend to change the prices; and modifying the prices further to reflect buying and selling pressure.

24. A method as claimed in claim 22 wherein the step of changing the prices according to the financial assets and amounts of the financial assets traded includes communicating to the processor means, during a turn of play of a player, the name of a financial asset and number of units of the financial asset the player is trading.

25. A method as claimed in claim 22 wherein the step of changing prices include modifying the prices according to a number of machine read cards, the number of machine read cards defining time cycles.

26. A method as claimed in claim 22 wherein the cards have indicia so as to be humanly readable; including the step of changing the prices according to different information includes, by chance during a turn of play, reading a card by a player to himself in advance of a turn of play in which the card is to be machine read such that the information on the card is known only by the player during turns of play from the turn of play in which the player was allowed to read the card until the turn of play in which the card is machine read.

27. A method as claimed in claim 22 further comprising the step of forcing various occurrences by employing a game board around which players move during respective turns of play.

28. A method as claimed in claim 27 wherein the cards have indicia so as to be humanly readable including the step of changing the prices according to different information includes providing at least one section of the game board that indicates to a player stopping on it during his turn of play to read a card to himself in advance of a turn of play in which the card is to be machine read such that the player is the only player who knows the information on the card until the turn of play in which the card is machine read.

* * * * *